US011384952B2

(12) United States Patent
Zhu et al.

(10) Patent No.: US 11,384,952 B2
(45) Date of Patent: Jul. 12, 2022

(54) AIR DUCT MACHINE WITH SWITCHABLE AIR-OUT DIRECTIONS AND CONTROL METHOD THEREOF AND AIR-CONDITIONING APPARATUS

(71) Applicants: GREE ELECTRIC APPLIANCES (WUHAN) CO., LTD, Hubei (CN); GREE ELECTRIC APPLIANCES, INC. OF ZHUHAI, Guangdong (CN)

(72) Inventors: Jiangcheng Zhu, Guangdong (CN); Hui Du, Guangdong (CN); Yong Deng, Guangdong (CN); Biao Jiang, Guangdong (CN); Zhiwen Feng, Guangdong (CN)

(73) Assignees: GREE ELECTRIC APPLIANCES (WUHAN) CO., LTD, Hubei (CN); GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 309 days.

(21) Appl. No.: 16/607,268

(22) PCT Filed: Dec. 25, 2017

(86) PCT No.: PCT/CN2017/118317
§ 371 (c)(1),
(2) Date: Oct. 22, 2019

(87) PCT Pub. No.: WO2018/227924
PCT Pub. Date: Dec. 20, 2018

(65) Prior Publication Data

US 2020/0300496 A1 Sep. 24, 2020

(30) Foreign Application Priority Data

Jun. 14, 2017 (CN) ..... 201710445762.6

(51) Int. Cl.
*F24F 1/0014* (2019.01)
*F24F 11/79* (2018.01)
(Continued)

(52) U.S. Cl.
CPC ..... *F24F 11/79* (2018.01); *F24F 1/0014* (2013.01); *F24F 1/0025* (2013.01); *F24F 1/0033* (2013.01)

(58) Field of Classification Search
CPC ..... F24F 11/79; F24F 1/0014; F24F 1/0025; F24F 1/0033; F24F 11/77; F24F 3/02; F24F 11/74; F24F 2110/32
(Continued)

(56) References Cited

U.S. PATENT DOCUMENTS

2009/0107167 A1 4/2009 Kim et al.
2016/0116180 A1* 4/2016 Hu ..... F24F 11/77 700/276

FOREIGN PATENT DOCUMENTS

CN 202560599 U 11/2012
CN 103673076 A 3/2014
(Continued)

OTHER PUBLICATIONS

Deng, Chaosheng, CN105276782 Translation.pdf, "Air flue structure, indoor unit and air conditioning plant", Jan. 2016, pp. 1-9.*
(Continued)

*Primary Examiner* — Avinash A Savani
*Assistant Examiner* — Ryan L Faulkner
(74) *Attorney, Agent, or Firm* — Oblon, McClelland, Maier & Neustadt, L.L.P.

(57) ABSTRACT

The present application provides an air duct machine with switchable air-out directions and a control method thereof, and an air-conditioning apparatus. The air duct machine with switchable air-out directions comprises: a housing, a first fan
(Continued)

(3), a second fan (4) and a control mechanism, wherein the first fan (3) and the second fan (4) are both mounted in the housing, the housing has a first vent (1) at a side corresponding to the first fan (3) and a second vent (2) at a side corresponding to the second fan (4), and a communicating air channel is formed between the first vent (1) and the second vent (2); the control mechanism is used for linkage control of the rotation of two fans, and when one fan serves as an air supply fan, the other fan is controlled as a regulating fan to rotate in a direction opposite to a direction in which air is supplied to a corresponding vent, and reverse rotation of the regulating fan reduces obstruction to return air, optimizes a flow field of return air, enlarges the area of return air, increases the air output amount, and effectively lowers the noise.

5 Claims, 2 Drawing Sheets

(51) Int. Cl.
*F24F 1/0025* (2019.01)
*F24F 1/0033* (2019.01)

(58) Field of Classification Search
USPC ..... 454/233
See application file for complete search history.

(56) References Cited

FOREIGN PATENT DOCUMENTS

| | | | |
|---|---|---|---|
| CN | 103776090 | A | 5/2014 |
| CN | 204285717 | U | 4/2015 |
| CN | 105276782 | A | 1/2016 |
| CN | 205065934 | U | 3/2016 |
| CN | 106440030 | A | 2/2017 |
| CN | 107084440 | A | 8/2017 |
| JP | 11-201490 | A | 7/1999 |
| JP | 2001-165495 | A | 6/2001 |
| KR | 10-0644544 | B1 | 11/2006 |
| WO | WO 2007/136202 | A1 | 11/2007 |

OTHER PUBLICATIONS

Extended European Search Report dated Jan. 26, 2021 in European Patent Application No. 17913779.9, 8 pages.
International Search Report dated Mar. 21, 2018, in PCT/CN2017/118317, 4 pages.

* cited by examiner

AIR DUCT MACHINE WITH SWITCHABLE AIR-OUT DIRECTIONS AND CONTROL METHOD THEREOF AND AIR-CONDITIONING APPARATUS

The present application is a continuation application of PCT application No. PCT/CN2017/118317, filed Dec. 25, 2017, herein incorporated by reference, which claims the priority of Chinese patent application No. 201710445762.6, filed in the Chinese Patent Office on Jun. 14, 2017, and entitled "Air duct machine with switchable air-out directions and control method thereof and air-conditioning apparatus", the entire contents of which are herein incorporated by reference.

FIELD OF THE APPLICATION

The present application relates to the technical field of air conditioning, in particular to an air duct machine with switchable air-out directions and a control method thereof and an air-conditioning apparatus.

BACKGROUND OF THE APPLICATION

An air duct machine is short for a duct-type air conditioning equipment, and is a type of central air conditioner. Generally, it connects an indoor unit and an outdoor unit, which are connected through a copper pipe. An air supply pipe is led from indoors and introduced to each room, and air is returned to the indoor unit through an air return pipe, and then cooled and mixed with fresh air to supply fresh air again.

As to an air duct machine in the prior art, to satisfy different air-out requirements, a cross-flow fan should be respectively arranged at a sideward vent and a downward vent. When one fan rotates as an air supply fan, the other fan is static which is at an air return position, and its motion state has a great influence on return air, thereby impeding entrance of return air and reducing the air return amount, and the contact between return air and blades of a static fan will generate unnecessary noises.

SUMMARY OF THE APPLICATION

In order to overcome the above technical shortcomings, a technical problem to be solved in the present application is to provide an air duct machine with switchable air-out directions and a control method thereof and an air-conditioning apparatus, so as to increase the air output amount and lower the noise.

In order to solve the above technical problem, the present application provides an air duct machine with switchable air-out directions, including a housing, a first fan, a second fan and a control mechanism, wherein the first fan and the second fan are both mounted in the housing, the housing has a first vent and a second vent, the first vent is disposed on the side of the first fan, the second vent is disposed on the side of the second fan, and a communicating air channel is formed between the first vent and the second vent;

in an air-out state of the first vent, the first fan serves as an air-out fan and the second fan serves as a regulating fan, and the control mechanism is configured to control the first fan to supply air to the first vent and to control the second fan to rotate in a direction opposite to a direction in which air is supplied to the second vent; and in an air-out state of the second vent, the second fan serves as an air-out fan and the first fan serves as a regulating fan, the control mechanism is configured to control the second fan to supply air to the second vent and to control the first fan to rotate in a direction opposite to a direction in which air is supplied to the first vent.

Further, the first fan and the second fan are both cross-flow fans.

Further, the first fan and the second fan are configured to rotate in the same direction.

Further, the first vent is located at the lateral side of the housing, and the second vent is located at the bottom of the housing.

Further, the range of a rotational speed W1 of the air-out fan is 400 r/min-1400 r/min.

Further, a rotational speed W2 of the regulating fan and the rotational speed W1 of the air-out fan satisfy the following relationship:

$$W2=W1/3+A$$

wherein 60 r/min<A<120 r/min.

The present application further correspondingly provides a control method of an air duct machine with switchable air-out directions, including:

in an air-out state of a first vent, causing the first fan which serves as an air-out fan to rotate towards a direction in which air is supplied to the first vent, and causing the second fan which serves as a regulating fan to rotate towards a direction opposite to a direction in which air is supplied to the second vent;

in an air-out state of the second vent, causing the second fan which serves as an air-out fan to rotate towards a direction in which air is supplied to the second vent, and causing the first fan which serves as a regulating fan to rotate towards a direction opposite to a direction in which air is supplied to the first vent.

Further, the range of a rotational speed W1 of the air-out fan is 400 r/min-1400 r/min.

Further, a rotational speed W2 of the regulating fan and the rotational speed W1 of the air-out fan satisfy the following relationship:

$$W2=W1/3+A$$

wherein 60 r/min<A<120 r/min.

The present application further provides an air-conditioning apparatus which includes the above air duct machine with switchable air-out directions.

Therefore, based on the above technical solution, in the case of an air duct machine with switchable air-out directions and a control method thereof in the present application, through linkage control of rotation of two fans, when one fan serves as an air supply fan, the other fan is controlled as a regulating fan to rotate in a direction opposite to a direction in which air is supplied to the corresponding vent, and the reverse rotation of the regulating fan reduces obstruction to return air, optimizes a flow field of return air, enlarges the area of return air, increases the air output amount, and effectively lowers the noise. An air-conditioning apparatus provided in the present application also correspondingly has the above beneficial technical effects.

BRIEF DESCRIPTION OF THE ACCOMPANYING DRAWINGS

Accompanying drawings illustrated herein are used for providing a further understanding of the present application, and constitute a part of the present application. Schematic embodiments of the present application and illustrations thereof are merely for explaining the present application, rather than constituting improper limitations to the present application. In the drawings.

DETAILED DESCRIPTION OF THE PREFERRED EMBODIMENTS

A further detailed description will be given below on technical solutions of the present application through accompanying drawings and embodiments.

Specific embodiments of the present application are for the convenience of a further description of concepts, technical problems to be solved, technical features constituting technical solutions, and technical effects brought thereby, of the present application. It should be noted that illustrations of these embodiments do not constitute limitations to the present application. In addition, the technical features involved in the embodiments of the present application described below can be combined with each other as long as they are not conflicted with one another.

Figure 1:
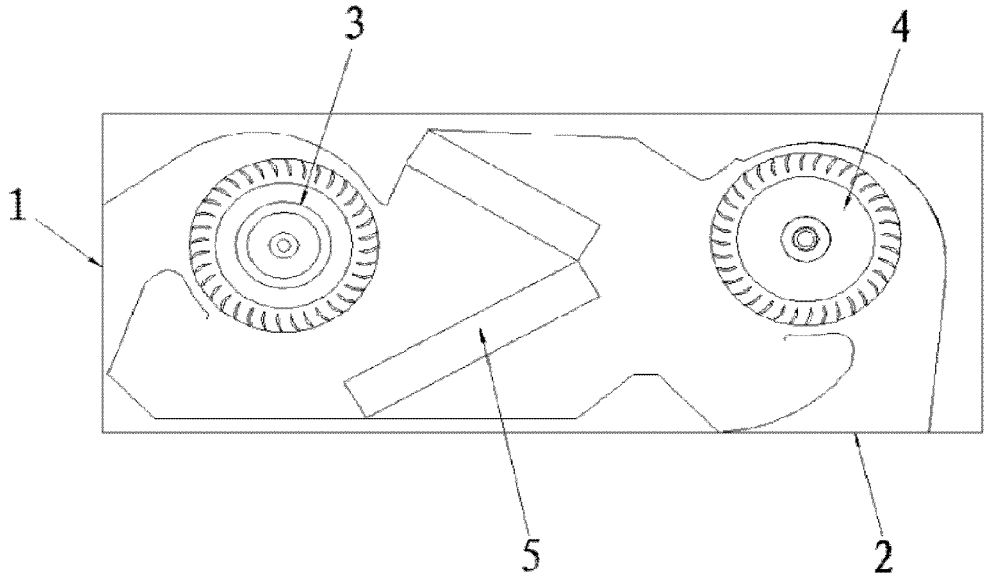
FIG. 1 is a structural schematic diagram of an air duct machine with switchable air-out directions of the present application.
Figure 2:
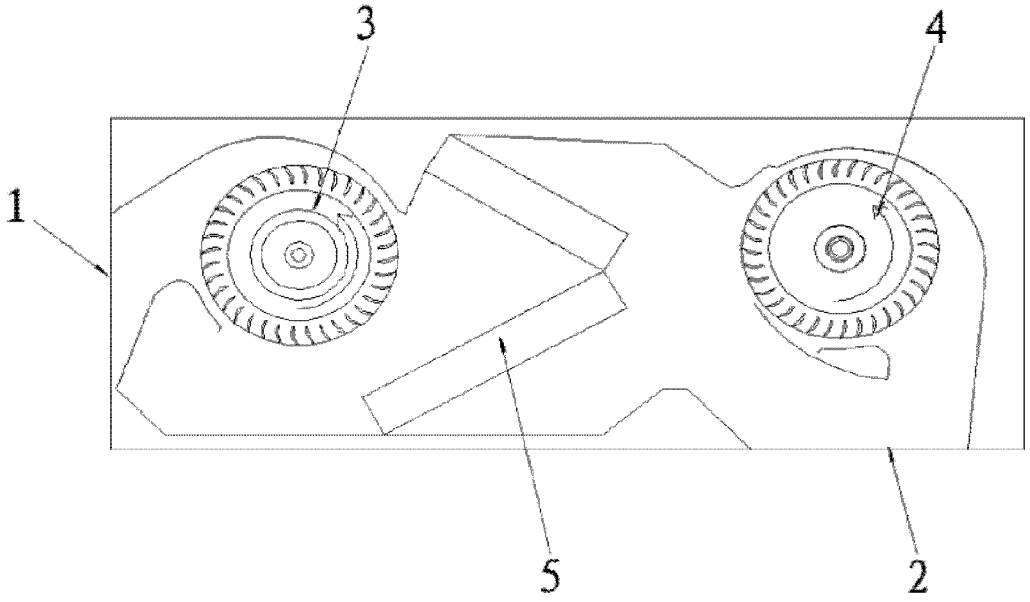
FIGS. 2 and 3 are respectively structural schematic diagrams of an air duct machine with switchable air-out directions of the present application respectively in an air-out state of a first vent and in an air-out state of a second vent.
Figure 3:
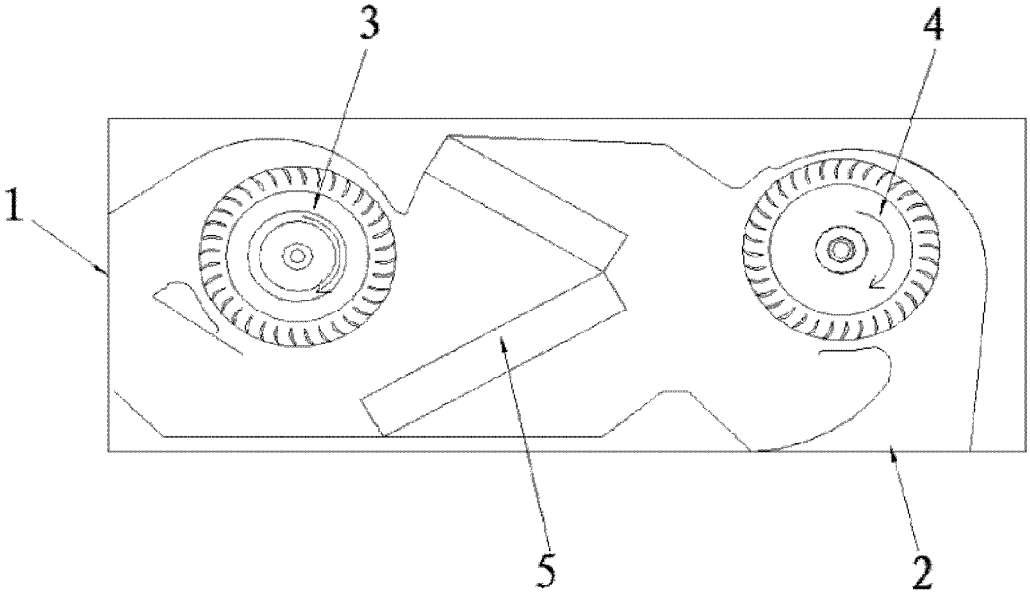

In a schematic embodiment of an air duct machine with switchable air-out directions of the present application, as shown in FIGS. 1 to 3, an air duct machine with switchable air-out directions includes a housing, a first fan 3, a second fan 4, a heat exchanger 5 and a control mechanism (not shown in the figures), wherein the first fan 3 and the second fan 4 are both mounted in the housing, the housing is formed with a first vent 1 at a side corresponding to the first fan 3, the housing is formed with a second vent 2 at a side corresponding to the second fan 4, specifically or preferably, the first vent 1 is located at the lateral side of the housing, and the second vent 2 is located at the bottom the housing. A communicating air channel is formed between the first vent 1 and the second vent 2, the heat exchanger 5 is arranged in a middle region of the air channel, and is located between the first fan 3 and the second fan 4.

as shown in FIG. 2, in an air-out state of the first vent 1, the control mechanism is configured to control the first fan 3 which serves as an air-out fan to supply air to the first vent 1, and to control the second fan 4 which serves as a regulating fan to rotate in a direction opposite to a direction in which air is supplied to the second vent 2.

as shown in FIG. 3, in an air-out state of the second vent 2, the control mechanism is configured to control the second fan 4 which serves as an air-out fan to supply air to the second vent 2, and to control the first fan 3 which serves as a regulating fan to rotate in a direction opposite to a direction in which air is supplied to the first vent 1.

In the schematic embodiment, an air duct machine with switchable air-out directions of the present application utilizes a control mechanism to achieve linkage control of a first fan 3 and a second fan 4. As shown in FIG. 2, in an air-out state of a first vent 1, a control mechanism controls the first fan 3 which serves as an air-out fan to supply air to the first vent 1, wherein the first fan 3 rotates in an anti-clockwise direction, and the control mechanism controls the second fan 4 which serves as a regulating fan to rotate towards a direction opposite to a direction in which air is supplied to the second vent 2, wherein the second fan 4 rotates in an anti-clockwise direction, and the second vent 2 which serves as a return vent returns air to the air channel; and the reverse rotation of the second fan 4 reduces obstruction to return air, optimizes a flow field of return air, enlarges the area of return air, increases the air output amount, and effectively lowers the noise. As shown in FIG. 3, in an air-out state of the second vent 2, the control mechanism controls the second fan 4 which serves as an air-out fan to supply air to the second vent 2, wherein the second fan 4 rotates in a clockwise direction, and the control mechanism controls the first fan 3 which serves as a regulating fan to rotate in a direction opposite to a direction in which air is supplied to the first vent 1, wherein the first fan 3 rotates in an anti-clockwise direction, and the first vent 1 which serves as a return vent returns air to the air channel; and the reverse rotation of the first fan 3 reduces obstruction to return air, optimizes a flow field of return air, enlarges the area of return air, increases the air output amount, and effectively lowers the noise.

In an air duct machine with switchable air-out directions of the present application, a regulating fan rotates in a direction opposite to a direction in which air is supplied to a corresponding vent, such that the regulating fan exerts no negative effect on a flow field in a whole air channel, and further has a positive effect on the air channel flow field to some extent, so as to increase the air output amount and lower the noise.

In the above embodiment, the first fan 3 and the second fan 4 are both particularly cross-flow fans. Practice proves that when the fans in the air duct machine with switchable air-out directions of the present application are cross-flow fans, the effects of increasing the air output amount and lowering the noise are especially dramatic.

Preferably, as shown in FIGS. 2 and 3, the first fan 3 and the second fan 4 rotate in the same direction, in this way, during design, they can be driven by a same motor, thereby facilitating control. Of course, the rotational directions of the first fan 3 and the second fan 4 can also be opposite, which depends on design of blades of the fans and position selection of vents.

In order to demonstrate effects of an air duct machine with switchable air-out directions in increasing the air output amount, the inventor firstly measured data as shown in Table 1 below under the condition of only turning on an air-out fan (a rotational speed of a regulating fan is 0):

TABLE 1

| Sideward air outlet of a first vent 1 | | Downward air outlet of a second vent 2 | |
|---|---|---|---|
| Rotational speed (rpm) of a blade of a first fan 3 | Air output amount ($m^3$/min) | Rotational speed (rpm) of a blade of a second fan 4 | Air output amount ($m^3$/min) |
| 350 | 189 | 350 | 203 |
| 500 | 221 | 500 | 298 |
| 650 | 330 | 650 | 374 |
| 800 | 433 | 800 | 484 |
| 950 | 531 | 950 | 582 |

TABLE 1-continued

| Sideward air outlet of a first vent 1 | | Downward air outlet of a second vent 2 | |
|---|---|---|---|
| Rotational speed (rpm) of a blade of a first fan 3 | Air output amount ($m^3$/min) | Rotational speed (rpm) of a blade of a second fan 4 | Air output amount ($m^3$/min) |
| 1100 | 623 | 1100 | 661 |
| 1250 | 718 | 1250 | 748 |
| 1400 | 822 | 1400 | 845 |

Through a series of experiments, it was found that in order to enable an air duct machine with switchable air-out directions to maximize its performance, preferably, the range of a rotational speed W1 of an air-out fan is 400 r/min-1400 r/min.

Afterwards, the inventor found in measured data that when a rotational speed W2 of a regulating fan and a rotational speed W1 of an air-out fan are in a certain proportion, the rotational speed W2 of the regulating fan and the rotational speed W1 of the air-out fan satisfy the following relationship:

$$W2=W1/3+A$$

wherein A is a corrected parameter, and 60 r/min<A<120 r/min.

Within the preferred proportional range, a regulating fan exerts no negative effect on a flow field in the whole air channel, and further has a positive effect on the air channel flow field to some extent, and the effects of increasing the air output amount and lowering the noise of an air duct machine with switchable air-out directions are especially dramatic. Sideward air outlet of a first vent 1 (a first fan 3 is an air-out fan, and a second fan 4 is a regulating fan) is used as an example to measure experimental data as shown in Table 2 below:

TABLE 2

| Rotational speed (rpm) of a blade of a first fan 3 | Rotational speed (rpm) of a fan of a second fan 4 | Air amount ($m^3$/min) |
|---|---|---|
| 650 | 0 | 330 |
| 650 | 270 | 352 |
| 650 | 300 | 390 |
| 650 | 330 | 348 |
| 950 | 0 | 531 |
| 950 | 390 | 550 |
| 950 | 415 | 630 |
| 950 | 440 | 566 |
| 1250 | 0 | 718 |
| 1250 | 470 | 745 |
| 1250 | 510 | 860 |
| 1250 | 540 | 760 |

The present application correspondingly provides a control method of the abovementioned air duct machine with switchable air-out directions, including:

in an air-out state of the first vent 1, causing the first fan 3 which serves as an air-out fan to rotate towards a direction in which air is supplied to the first vent 1, and causing the second fan 4 which serves as a regulating fan to rotate towards a direction opposite to a direction in which air is supplied to the second vent 2;

in an air-out state of the second vent 2, causing the second fan 4 which serves as an air-out fan to rotate towards a direction in which air is supplied to the second vent 2, and causing the first fan 3 which serves as a regulating fan to rotate towards a direction opposite to a direction in which air is supplied to the first vent 1.

In the schematic embodiment, a control method of an air duct machine with switchable air-out directions of the present application achieves linkage control of a first fan 3 and a second fan 4. As shown in FIG. 2, in an air-out state of a first vent the first fan 3 which serves as an air-out fan is caused to supply air to the first vent 1, wherein the first fan 3 rotates in an anti-clockwise direction, and the second fan 4 which serves as a regulating fan is caused to rotate towards a direction opposite to a direction in which air is supplied to the second vent 2, wherein the second fan 4 rotates in an anti-clockwise direction, and the second vent 2 which serves as a return vent returns air to an air channel; and the reverse rotation of the second fan 4 reduces obstruction to return air, optimizes a flow field of return air, enlarges the area of return air, increases the air output amount, and effectively lowers the noise. As shown in FIG. 3, in an air-out state of the second vent 2, the second fan 4 which serves as an air-out fan is caused to supply air to the second vent 2, wherein the second fan 4 rotates in a clockwise direction, and the first fan 3 which serves as a regulating fan is caused to rotate in a direction opposite to a direction in which air is supplied to the first vent 1, wherein the first fan 3 rotates in an anti-clockwise direction, the first vent 1 which serves as a return vent returns air to the air channel; and the reverse rotation of the first fan 3 reduces obstruction to return air, optimizes a flow field of return air, enlarges the area of return air, increases the air output amount, and effectively lowers the noise.

Correspondingly, the range of a rotational speed W1 of the air-out fan is 400 r/min-1400 r/min, such that an air duct machine with switchable air-out directions can maximize its performance.

Still further, a rotational speed W2 of the regulating fan and the rotational speed W1 of the air-out fan satisfy the following relationship:

$$W2=W1/3+A$$

wherein 60 r/min<A<120 r/min.

Within the preferred proportional range, a regulating fan exerts no negative effect on a flow field in the whole air channel, and further has a positive effect on the air channel flow field to some extent, and the effects of increasing the air output amount and lowering the noise of an air duct machine with switchable air-out directions are especially dramatic.

The present application further provides an air-conditioning apparatus which includes the abovementioned air duct machine with switchable air-out directions. Since the air duct machine with switchable air-out directions of the present application can increase the air output amount and lower the noise, correspondingly, the air-conditioning apparatus of the present application also has the above beneficial technical effects, which will not be repeated herein.

A detailed description is given above on embodiments of the present application in combination with examples, however, the present application is not limited to the described embodiments. For those skilled in the art, various changes, modifications, equivalent substitutions and transformations made to these embodiments without departing from principles and essential spirits of the present application shall all fall within the protection scope of the present application.

The invention claimed is:

1. An air duct machine with switchable air-out directions, comprising:

a housing;

a first fan;

a second fan; and a control mechanism, wherein the first fan and the second fan are both mounted in the housing, the housing has a first vent and a second vent, the first vent is disposed on the side of the first fan and the second vent is disposed on the side of the second fan, and a communicating air channel is formed between the first vent and the second vent, in an air-out state of the first vent, the first fan serves as an air-out fan and the second fan serves as a regulating fan, and the control mechanism is configured to control the first fan to supply air to the first vent and to control the second fan to rotate in a direction opposite to a direction in which air is supplied to the second vent, and in an air-out state of the second vent, the second fan serves as an air-out fan and the first fan serves as a regulating fan, the control mechanism is configured to control the second fan to supply air to the second vent and to control the first fan to rotate in a direction opposite to a direction in which air is supplied to the first vent, wherein the range of a rotational speed $W_1$ of the air-out fan is 400 r/min-1400 r/min, and wherein a rotational speed $W_2$ of the regulating fan and the rotational speed $W_1$ of the air-out fan satisfy the following relationship:

$$W_2 = W_1/3 + A,$$

wherein 60 r/min<A<120 r/min.

2. The air duct machine with switchable air-out directions of claim 1, wherein the first fan and the second fan are both cross-flow fans.

3. The air duct machine with switchable air-out directions of claim 1, wherein the first vent is located at the lateral side of the housing, and the second vent is located at the bottom of the housing.

4. An air-conditioning apparatus, comprising the air duct machine with switchable air-out directions of claim 1.

5. A control method of an air duct machine with switchable air-out directions including a housing, a first fan, a second fan, and a control mechanism, wherein the first fan and the second fan are both mounted in the housing, the housing has a first vent and a second vent, the first vent is disposed on the side of the first fan and the second vent is disposed on the side of the second fan, and a communicating air channel is formed between the first vent and the second vent, comprising:

in an air-out state of the first vent, causing the first fan which serves as an air-out fan to rotate towards a direction in which air is supplied to the first vent, and causing the second fan which serves as a regulating fan to rotate towards a direction opposite to a direction in which air is supplied to the second vent; and in an air-out state of the second vent, causing the second fan which serves as an air-out fan to rotate towards a direction in which air is supplied to the second vent, and causing the first fan which serves as a regulating fan to rotate towards a direction opposite to a direction in which air is supplied to the first vent, wherein the range of a rotational speed $W_1$ of the air-out fan is 400 r/min-1400 r/min, and wherein a rotational speed W of the regulating fan and the rotational speed $W_1$ of the air-out fan satisfy the following relationship:

$$W_2 = W_1/3 + A,$$

wherein 60 r/min<A<120 r/min.

* * * * *